US005375563A

United States Patent [19]

Khinkis et al.

[11] Patent Number: 5,375,563

[45] Date of Patent: Dec. 27, 1994

[54] GAS-FIRED, POROUS MATRIX, SURFACE COMBUSTOR-FLUID HEATER

[75] Inventors: Mark J. Khinkis, Morton Grove; Tian-yu Xiong, Darien, both of Ill.

[73] Assignee: Institute of Gas Technology, Des Plaines, Ill.

[21] Appl. No.: 90,339

[22] Filed: Jul. 12, 1993

[51] Int. Cl.[5] ..... F22B 1/00

[52] U.S. Cl. ..... 122/4 D; 122/14; 122/18; 122/19; 122/367.4; 431/7; 431/170

[58] Field of Search ..... 122/4 D, 14, 18, 19, 122/367.4; 431/7, 170

[56] References Cited

U.S. PATENT DOCUMENTS 1,331,022 2/1920 Mathy .
3,188,366 6/1965 Flynn .
3,645,237 2/1972 Seth .
3,738,793 6/1973 Reid et al. .
3,833,338 9/1974 Badrock .
3,877,441 4/1975 Mach et al. ..... 122/367.4 X
3,921,712 11/1975 Renzi ..... 122/367.4 X
4,354,823 10/1982 Buehl et al. .
4,418,650 12/1983 Johnson et al. ..... 122/4 D
4,499,944 2/1985 Komakine .
4,597,734 7/1986 McCausland et al. .
4,605,369 8/1986 Buehl .
4,646,637 3/1987 Cloots .
4,666,400 5/1987 Vigneau .
4,673,349 6/1987 Abe et al. .
4,779,574 10/1988 Nilsson et al. .
4,865,122 9/1989 Brown .
4,899,695 2/1990 Brian et al. .
4,953,512 9/1990 Italiano ..... 122/4 D
4,966,101 10/1990 Maeda et al. .
5,014,652 5/1991 Hyldgaard .
5,026,269 6/1991 Ruottu .
5,054,436 10/1991 Dietz .

*Primary Examiner*—Edward G. Favors
*Attorney, Agent, or Firm*—Speckman, Pauley & Fejer

[57] ABSTRACT

A porous matrix, surface combustor-fluid heating apparatus comprising a combustion chamber, a cooled flow distributor proximate an inlet end of said combustion chamber and supporting a stationary porous bed within said combustion chamber, porous bed heat exchanger means embedded in said stationary porous bed and means for introducing a fuel/oxidant mixture into said stationary porous bed said fuel/oxidant mixture burning in said stationary porous bed.

19 Claims, 1 Drawing Sheet

GAS-FIRED, POROUS MATRIX, SURFACE COMBUSTOR-FLUID HEATER

BACKGROUND THE INVENTION

1. Field of the Invention

This invention relates to a process and apparatus for a surface combustor-fluid heater in which combustion is carried out within the pores of a stationary porous bed and heat transfer is achieved using heat exchange surfaces embedded in the stationary porous bed resulting in very high combustion intensity, very high heat transfer rates, improved energy utilization efficiency, ultra-low combustion emissions, and lower capital and operating costs.

2. Description of the Prior Art

In general, heat energy may be transmitted by conduction, convection and/or radiation. Heat transmission by radiation and utilization of infrared energy has many advantages over conventional heat transmission by convection and conduction. The operation and construction of infrared burners and radiant heaters is relatively simple, and thus more economical than other types of heat generation means. The intensity of radiant heat may be precisely controlled for greater efficiency and infrared energy may be focused, reflected, or polarized in accordance with the laws of optics. In addition, radiant heat is not ordinarily effected by air currents. One type of gas-fired infrared generator currently available is a surface combustion infrared burner having a radiating burner surface comprising a porous refractory. The combustion mixture is conveyed through the porous refractory and burns above the surface to heat the surface by conduction. One such burner is taught by U.S. Pat. No. 1,331,022. Other surface combustors are taught by U.S. Pat. Nos. 4,666,400, 4,605,369, 4,354,823, 3,188,366, 4,673,349, 3,833,338, and 4,597,734. See also U.S. Pat. No. 3,738,793 which teaches an illumination burner having a layered porous structure, the layered pores maintaining a stable flame in a thoria-ceria illumination burner in which combustion occurs not within the pores of the combustor, but rather on the surface of the top layer.

Control of combustion emissions, in particular $NO_x$ emissions, is an important requirement for surface combustors which are generally known to produce high combustion intensity and, thus, high combustion temperatures. It is generally known that to reduce $NO_x$ formation within the combustion process, it is necessary to simultaneously remove heat from the combustion process as combustion of the fuel occurs. U.S. Pat. No. 5,014,652 teaches a fluidized bed combustion reactor/-fluidized bed cooler comprising a vertical reactor chamber designed to contain two separate fluidized beds, one of which contains cooling coils through which a cooling fluid is flowing to remove heat from the bed. U.S. Pat. No. 3,645,237 teaches a fluidized bed water heater in which water is heated or steam is produced by passing water through heating coils embedded in the fluidized bed. Similarly, U.S. Pat. No. 4,499,944, U.S. Pat. No. 4,779,574, and U.S. Pat. No. 4,646,637 teach a heat exchanger installed in a fluidized bed.

U.S. Pat. No. 4,966,101 teaches a fluidized bed combustion apparatus having a plurality of catalyst tubes filled with catalysts for reforming hydrocarbon gas into steam and arranged in both a horizontal and vertical direction both in and above a fluidized bed in a fluidizing chamber. U.S. Pat. No. 4,899,695 teaches a fluidized bed combustion reaction in which heat is transferred from the fluidized bed to water-containing tubes surrounding the reactor.

U.S. Pat. No. 4,865,122 teaches a fluidized bed heat exchanger for enhanced heat transfer between two liquids having different heat content in which a first liquid is directed through a shell enclosure containing a bed material supported on a distribution plate, the pressure of the liquid controlling the level of fluidization of the bed material, and a second liquid is directed through tubes positioned in the bed material, each of which tube containers includes bed materials supported on a distribution plate. The second liquid is provided at sufficient pressure through the tube containers to fluidize the bed material therein.

U.S. Pat. No. 5,054,436 teaches a recycle bubbling bed formed integrally with a furnace which functions as a heat exchanger and a combustor in which flue gases and entrained particulate materials from a circulating fluidized bed in the furnace are separated, the flue gases are passed to a heat recovery area while the separated solids are passed to the recycle bubbling fluidized bed, and heat exchange surfaces are provided in the recycle bubbling bed to adsorb combustion heat and the solids' sensible heat, and a bypass compartment is provided in another compartment of the recycle bubbling bed through which the solids directly pass to a circulating bed in the furnace during start-up and low load conditions.

U.S. Pat. No. 5,026,269 teaches a nozzle bottom comprising a plurality of fluidizing nozzles for introducing fluidizing air into the reactor chamber of a fluidized bed reactor.

One problem associated with fluidized bed combustors is the amount of particulate matter generated by such beds which is carried out with the products of combustion exhausted by the combustor. In addition, the abrasiveness of the fluidized bed particles against the outer surfaces of heat exchangers disposed in the fluidized bed causes erosion of the heat exchanger surfaces. Finally, pressure drop of flow through the fluidized bed is high due to the high flow velocity required for fluidization.

SUMMARY OF THE INVENTION

It is an object of this invention to provide a process and apparatus for gas fired combustion and fluid heating which produces ultra-low combustion emissions.

It is another object of this invention to provide a process and apparatus for gas fired combustion and fluid heating having higher combustion intensity, high heat transfer rates, and, thus, higher energy utilization efficiency than known gas fired combustion and fluid heating devices.

These and other objects of this invention are achieved by a porous matrix, surface combustor-fluid heating apparatus comprising at least one combustor wall which forms a combustion chamber, said combustion chamber having an inlet end and an outlet end. Proximate the inlet end of the combustion chamber is a cooled flow distributor which supports a stationary porous bed within the combustion chamber. Embedded within the stationary porous bed is a means for heat exchange by which heat generated by combustion within the stationary porous bed is removed therefrom. Means for introducing a fuel/oxidant mixture into the stationary porous bed are preferably provided proximate the inlet end of said combustion chamber.

The porous matrix, surface combustor-fluid heater in accordance with this invention is a combined combustion and heat transfer device in which the heat exchange surfaces are embedded in a stationary porous bed in which a gaseous fuel is burned. Because fuel combustion takes place in a great number of the small pores in the porous media, combustion intensity is very high. The overall heat transfer from the products of combustion to the load is significantly enhanced because of the intense combined heat convection and radiation. Removing heat simultaneously as combustion of the gaseous fuel occurs results in a reduction of $NO_x$ formation.

Utilizing the specially designed internally cooled flow distributor establishes a stable combustion above the flow distributor without a risk of flame firing back.

In accordance with this invention, the combustion density achieved is more than 10 times higher than conventional gas burners. The overall heat transfer rate is more than 5 times higher than conventional commercially available thermal fluid heaters. And, $NO_x$ and CO emissions are as low as 15 VPPM (corrected to 0% $O_2$), a reduction of about 75% compared to conventional gas burners.

BRIEF DESCRIPTION OF THE DRAWINGS

These and other features of this invention will be better understood from the following detailed description taken in conjunction with the drawings wherein.

DESCRIPTION OF PREFERRED EMBODIMENTS

Figure 1:
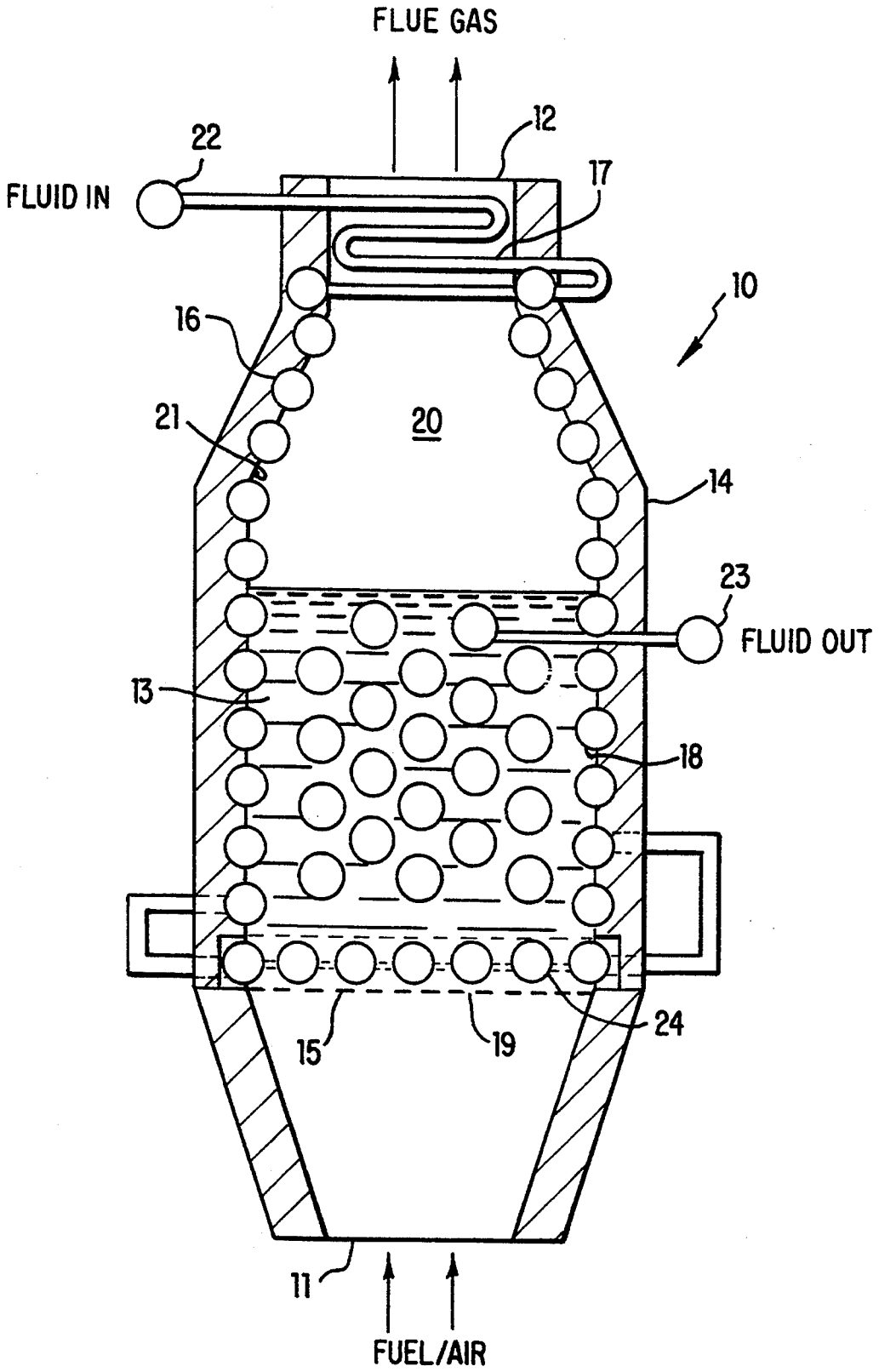
FIG. 1 shows a cross-sectional side view of a gas fired, porous matrix, surface combustor-fluid heater in accordance with one embodiment of this invention.

In accordance with one embodiment of this invention as shown in FIG. 1, the gas fired, porous matrix, surface combustor-fluid heater of this invention comprises at least one combustor wall 14 forming combustion chamber 20 having inlet end 11 and outlet end 12. Proximate inlet end 11 of combustion chamber 20 is cooled flow distributor 15 having openings 19 through which fuel and air introduced into inlet end 11 flow into combustion chamber 20. Cooled flow distributor 15 supports stationary porous bed 13 within combustion chamber 20. Embedded in stationary porous bed 13 is porous bed heat exchanger means 18 in the form of a plurality of rows of fluid cooled tubes. In accordance with a preferred embodiment of this invention, the row of fluid cooled tubes 18 nearest cooled flow distributor 15 is disposed between about 1.0 and about 4.0 inches from cooled flow distributor 15.

Surface combustor fluid heating apparatus 10 further comprises combustion wall heat exchanger means disposed on interior surface 21 of combustor wall 14 and in outlet end 12 of combustion chamber 20. In accordance with one embodiment of this invention, said combustor wall heat exchanger means comprises at least one tube coil 16 disposed on interior surface 21 of combustor wall and at least one tube coil 17 in outlet end 12 of combustion chamber 20. In accordance with a preferred embodiment of this invention, tube coil 16 disposed on interior surface 21 of combustor wall 14 and tube coil 17 disposed in outlet end 12 of combustion chamber 20 are in communication with one another such that cooling fluid is introduced into tube coil 17 through fluid inlet 22 and then flows through tube coil 16 disposed on interior surface 21 of combustor wall 14. In accordance with yet another embodiment of this invention, tube coil 16 disposed on interior surface 21 of combustor wall 14 is in communication with said plurality of rows of fluid cooled tubes 18 disposed in stationary porous bed 13 such that cooling fluid flowing through tube coil 16 subsequently flows through fluid cooled tubes 18 after which it exits through fluid outlet 23. The heated fluid is then communicated to any number of applications requiring a heated fluid, such as a water heater.

Cooled flow distributor 15, in accordance with one embodiment of this invention, comprises a wall having a plurality of openings 19 through which a fuel/oxidant mixture flows into stationary porous bed 13. To provide cooling to cooled flow distributor 15, at least one distributor fluid cooled tube is disposed within cooled flow distributor 15. In a particularly preferred embodiment of this invention, said cooled flow distributor wall 15 is in the form of a membrane wall.

To provide the desired heat exchange between stationary porous bed 13 and fluid cooled tube 18 disposed in stationary porous bed 13, it is preferred that the outside diameter of fluid cooled tube 18 be between about 0.5 to about 3.0 inches. In addition, the ratio of tube spacing within stationary porous bed 13 (horizontally and vertically) to the diameter of fluid cooled tubes 18 is between about 1.5 to about 3.0.

Stationary porous bed 13 comprises a plurality of high temperature ceramic particles, preferably selected from the group consisting of alumina, silicon carbide, zirconia, and mixtures thereof. The mean diameter of said ceramic particles is between about 0.1 and about 1.0 inches.

While in the foregoing specification this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principles of the invention.

We claim:

1. A porous matrix, surface combustor-fluid heating apparatus comprising:

at least one combustor wall forming a combustion chamber, said combustion chamber having an inlet end and an outlet end;

a cooled flow distributor proximate said inlet end of said combustion chamber;

a stationary porous bed supported on said cooled flow distributor;

porous bed heat exchanger means embedded in said stationary porous bed; and means for introducing a fuel/oxidant mixture into said stationary porous bed.

2. A porous matrix, surface combustor-fluid heating apparatus in accordance with claim 1 further comprising combustor wall heat exchanger means disposed on the interior surface of said combustor wall and in said outlet end of said combustion chamber.

3. A porous matrix, surface combustor-fluid heating apparatus in accordance with claim 1, wherein said stationary porous bed comprises a plurality of high-temperature ceramic particles.

4. A porous matrix, surface combustor-fluid heating apparatus in accordance with claim 1, wherein said cooled flow distributor comprises a wall having a plurality of openings through which said fuel/oxidant mixture flows into said stationary porous bed.

5. A porous matrix, surface combustor-fluid heating apparatus in accordance with claim 1, wherein said cooled flow distributor comprises a wall having a plurality of openings through which said fuel/oxidant mixture flows into said stationary porous bed and at least one fluid-cooled tube disposed within said wall.

6. A porous matrix, surface combustor-fluid heating apparatus in accordance with claim 4, wherein said wall is a membrane wall.

7. A porous matrix, surface combustor-fluid heating apparatus in accordance with claim 5, wherein said wall is a membrane wall.

8. A porous matrix, surface combustor-fluid heating apparatus in accordance with claim 1, wherein said fuel is a gaseous fuel.

9. A porous matrix, surface combustor-fluid heating apparatus in accordance with claim 1, wherein said porous bed heat exchanger means comprises at least one fluid-cooled tube disposed in said stationary porous bed.

10. A porous matrix, surface combustor-fluid heating apparatus in accordance with claim 9, wherein the outside diameter of said fluid-cooled tube is between about 0.5 and about 3.0 inches.

11. A porous matrix, surface combustor-fluid heating apparatus in accordance with claim 9, wherein said tube is disposed at least about 1.0 to about 4.0 inches above said cooled flow distributor.

12. A porous matrix, surface combustor-fluid heating apparatus in accordance with claim 3, wherein said particles have a mean diameter of between about 0.1 and about 1.0 inches.

13. A porous matrix, surface combustor-fluid heating apparatus in accordance with claim 3, wherein said high-temperature ceramic particles are selected from the group consisting of alumina, silicon carbide, zirconia and mixtures thereof.

14. A porous matrix, surface combustor-fluid heating apparatus in accordance with claim 1, wherein said porous bed heat exchanger means comprises a plurality of rows of fluid-cooled tubes disposed in said stationary porous bed, the row nearest said cooled flow distributor being disposed between about 1.0 and about 4.0 inches from said cooled flow distributor.

15. A porous matrix, surface combustor-fluid heating apparatus in accordance with claim 2, wherein said combustor wall heat exchanger means comprises at least one tube coil disposed on the interior surface of said combustor wall and in said outlet end of said combustion chamber.

16. A process for combustion of a gaseous fuel comprising:

introducing a fuel/oxidant mixture into an inlet end of a combustion chamber having a stationary porous bed supported on a cooled flow distributor;

burning said fuel/oxidant mixture within the pores of said stationary porous bed; and removing heat resulting from said combustion from said combustion chamber.

17. A process for combustion of a gaseous fuel in accordance with claim 16, wherein said gaseous fuel is natural gas.

18. A process in accordance with claim 16, wherein at least a portion of said heat is removed by circulating a cooling fluid through at least one fluid tube disposed within said stationary porous bed.

19. A process in accordance with claim 18, wherein at least a portion of said heat is removed by circulating said cooling fluid through at least one fluid tube coil disposed on an inner surface of a combustion chamber wall and in an outlet end of said combustion chamber.

* * * * *